US005240224A

United States Patent [19]

Adams

[11] Patent Number: 5,240,224

[45] Date of Patent: Aug. 31, 1993

[54] ANCHOR BOLT HOLDER

[76] Inventor: John H. Adams, 1801 21st Ave., Kingsburg, Calif. 93631

[21] Appl. No.: 874,275

[22] Filed: Apr. 24, 1992

[51] Int. Cl.[5] ..... B28B 23/00

[52] U.S. Cl. ..... 249/93; 52/699; 249/219.1; 264/35

[58] Field of Search ..... 249/91, 93, 94, 219.1, 249/83, 40, 207, 210; 52/699, 700, 701; 264/35

[56] References Cited

U.S. PATENT DOCUMENTS

| | | | |
|---|---|---|---|
| 3,150,429 | 9/1964 | Shaffer | 249/219.1 |
| 3,471,118 | 10/1969 | Bormann et al. | 249/91 |
| 3,960,356 | 6/1976 | Adams | 249/91 |
| 4,736,554 | 4/1988 | Tyler | 52/700 |
| 5,052,654 | 10/1991 | Means et al. | 249/219.1 |
| 5,060,436 | 10/1991 | Delgado et al. | 52/699 |

*Primary Examiner*—Khanh P. Nguyen
*Attorney, Agent, or Firm*—John J. Leavitt

[57] ABSTRACT

Presented is a holder for retaining an anchor bolt in position for partial embedding in concrete poured into a form to which the holder and anchor bolt are secured. The holder is formed by a pair of side-by-side leg members connected integrally at one end so that any attempt to separate the legs imposes a resilient bias on the legs tending to return them to their side-by-side relationship. The legs are formed on adjacent sides with registering notches in which the anchor bolt may be engaged. A sheetmetal clip is mounted on one of the legs for axial displacement therealong, and includes a pair of opposed notches for registration with the registering notches formed in the legs to more securely grip the anchor bolt. Detent projections are formed on the sides of the clip cooperating with apertures in the leg on which the clip is mounted to releasably retain the clip in an axially adjusted position. A slidable collar embraces both legs and may be slid into binding engagement with the legs adjacent an anchor bolt supported by the holder.

6 Claims, 2 Drawing Sheets

ANCHOR BOLT HOLDER

BACKGROUND OF THE INVENTION

1. Field of the Invention

This invention relates to a temporary support structure for an anchor bolt, and particularly to an anchor bolt holder that may be detachably applied to the anchor bolt and to the concrete form to retain the anchor bolt in position while the concrete is poured.

2. Description of the Prior Art

The invention described and claimed herein is an improvement over the invention described and claimed in my U.S. Pat. No. 3,960,356 and the patents cited therein.

Conventional form-mounted anchor bolt supporting devices are frequently difficult and time consuming to install with the anchor bolts in proper position. They are not always wholly effective in that at times the anchor bolt is permitted to shift from the initial positional setting during pouring and vibrating of the concrete. The invention described in my previous U.S. Pat. No. 3,960,356 was conceived in a successful effort to overcome such problems, and the invention forming the subject matter herein improves on my previous structure in that it functions to more securely retain an anchor bolt in the position selected.

The present invention provides, as an important object, an anchor bolt holder which is simple in form and readily and easily manually applied to the anchor bolt, with the anchor bolt firmly frictionally gripped and detachably supported by the holder, and the assembly of anchor bolt and detachable holder then quickly and accurately applied to the concrete form to temporarily retain the anchor bolt in proper position during the pouring of the concrete.

Another object of the invention is the provision of an anchor bolt holder that is easily and accurately yet detachably applied to the concrete form so as to be removable when the concrete sets up sufficiently to retain the anchor bolt.

The present invention provides, as another important object, a holder comprising an elongated bifurcated body having elongated side-by-side legs integrally connected at one end and having free ends at the opposite end which when separated to engage an anchor bolt are resiliently biased toward one another to frictionally grip the anchor bolt therebetween.

Still another object of the invention is the provision of slidable means on one of the elongated legs that may be selectively displaced along the leg on which it is mounted to properly position and engage an anchor bolt.

A still further object of the invention is the provision of means along the length of the bifurcated legs enabling the temporary placement of nails through the legs to retain them detachably secured to the concrete form with the anchor bolt suspended therefrom.

The present invention provides, as a further object, an anchor bolt holder which is designed for ease and economy of manufacture.

The present invention provides, as a still further object, a practical, reliable, and durable anchor bolt holder, and one which is exceedingly effective for the purpose for which it is designed.

The invention possesses other objects and features of advantage, some of which, with the foregoing, will be apparent from the following description and the drawings. It is to be understood however that the invention is not limited to the embodiment illustrated and described since it may be embodied in various forms within the scope of the appended claims.

SUMMARY OF THE INVENTION

In terms of broad inclusion, the anchor bolt holder of the invention comprises a bifurcated body to form two side-by-side legs integrally connected at only one end and separable to admit an anchor bolt therebetween perpendicular thereto. Means are provided on one of the legs longitudinally and selectively displaceable into registry with recesses formed in the legs to frictionally and temporarily detachably grasp an anchor bolt and retain it suspended from the legs when the holder is detachably secured to the upper surfaces of a concrete form. Means are provided slidably displaceable along the body of the holder to increase the frictional grip of the holder on the anchor bolt.

DESCRIPTION OF THE PREFERRED EMBODIMENT

Figure 1:
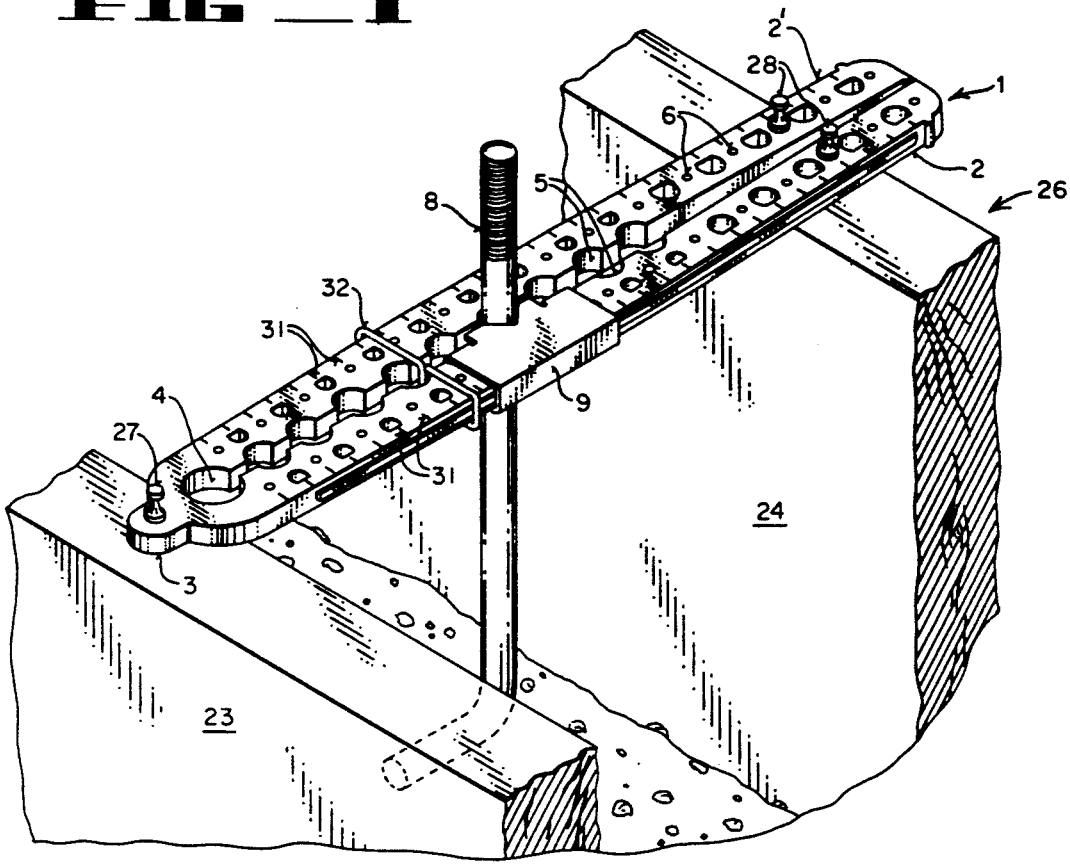
FIG. 1 is a perspective view of the anchor bolt holder shown in a position of use gripped to an anchor bolt to retain it in proper position in relation to a concrete form, the latter shown broken away to reduce its size.

Referring now more particularly to the drawings and to the characters of reference marked thereon, the anchor bolt holder of the present invention includes a one-piece elongated body, indicated generally by the numeral 1, fabricated preferably from a heavy-duty synthetic resinous material (plastic) such as polyethylene.

The body 1 is bifurcated to provide a pair of juxtaposed or side-by-side elongated legs 2 and 2' connected together at one end by an integral head 3. A relatively large symmetrically disposed circular opening 4 is provided in the body at the integral juncture of the legs 2, 2' and the head 3, and imparts to the head a generally C-shape which provides a spring hinge due to the slight resilient bendability of the plastic from which the body is formed. In short, the legs 2, 2' which initially diverge in a direction away from the head 3 (FIG. 3), can be manually sprung toward each other and into substantial parallelism for a purpose to be described hereinafter.

Intermediate the ends thereof, the legs 2,2' are each formed, in the inner or adjacent longitudinal edges thereof, with a row of half-circle notches 5, with the corresponding notches in registry, and the notches 5 being equally spaced lengthwise of the legs 2 and 2'.

Each leg 2 and 2', between its inner and outer longitudinal edges, is provided with a row of equally spaced nail-receiving holes 6 extending therethrough from one face to the other. The holes are positioned laterally outwardly of, and spaced half the distance between adjacent notches 5. The purpose for these holes is to receive nails that detachably retain the anchor bolt holder to the top edges of concrete form boards as will hereinafter be explained.

Figure 5:
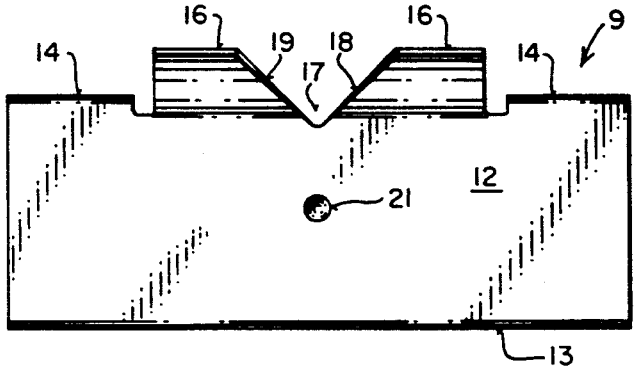
FIG. 5 is a plan view of the selectively displaceable clip means shown apart from the holder.
Figure 6:
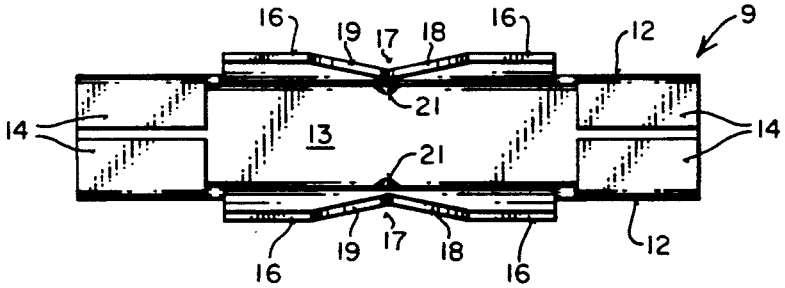
FIG. 6 is a top plan view of the clip means illustrated in FIG. 5.
Figure 7:
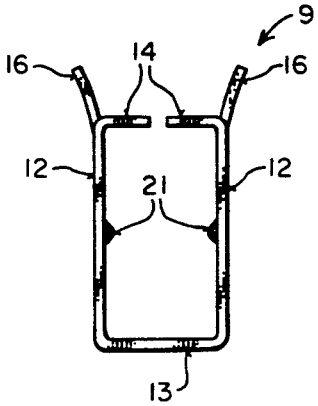
FIG. 7 is an end elevational view of the clip means illustrated in FIG. 5.

In addition to the nail-receiving holes 6 formed in the legs 2 and 2', there are also formed therein through holes 7 which are medianly spaced between the nail-receiving holes 6, and which are semi-circular as shown, a portion 8 of the periphery of each hole 7 constituting a chord. These holes perform a double function. In the mold in which the holder is formed, these holes serve to cool the holder faster than would be the case if the holes were omitted. They also function as a part of a detent as will hereinafter be explained. Slidably mounted on the leg 2, and cooperating with the through holes 7, is an anchor bolt clip designated generally by the numeral 9, and formed from sheetmetal as illustrated in FIGS. 5, 6 and 7.

Figure 2:
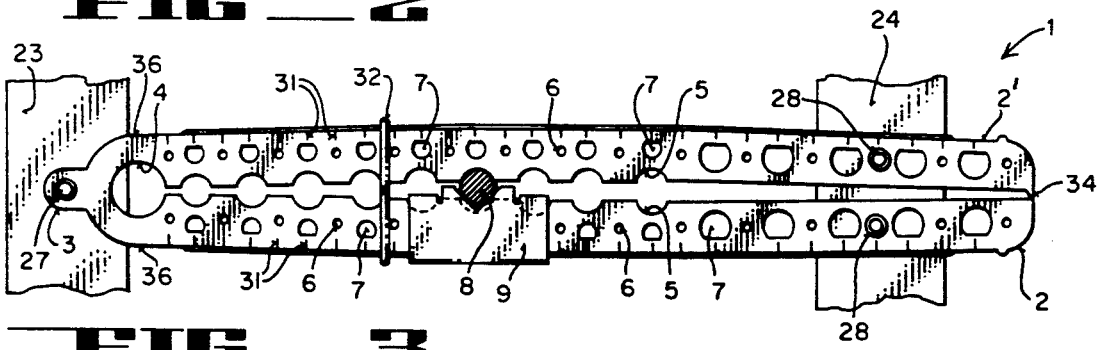
FIG. 2 is an enlarged plan view of the assembly illustrated in FIG. 1.

The clip 9 is generally rectangular in its configuration so as to envelop or fit slidably around the generally rectangular cross-sectional configuration of the leg 2. As seen in FIG. 5, the clip is formed with identical parallel side walls 12 integral with a bottom or edge wall 13 and perpendicular thereto as shown in FIG. 7. At their edges remote from the edge wall 13, the side walls are integral with mutually reaching transverse tabs 14 perpendicular to the side walls and arranged in pairs spaced at opposite ends of the clip and with the side walls and edge wall 13 forming a tubular structure through which the leg 2 may be inserted. Each of the side walls 12, between the spaced tab pairs 14, is formed with a pair of projecting flanges 16 that are angularly inclined out of the plane of the side wall with which the pair of tabs are associated and of which they are an integral extension. Formed between the flanges 16 of each pair thereof is a V-shaped notch 17 defined by angularly disposed edges 18 and 19. Formed medianly in each side wall 12 is a dimple 21 that projects into the interior of the tubular passageway formed by the clip. It will thus be seen that when the clip is slipped over the free end of the leg 2 in the orientation illustrated in FIGS. 1 and 2, the dimples 21 cooperate with the through holes 7 to form a detent-like interengagement that enables intentional slidable displacement of the clip to adjust its position along the leg 2, but which retain the clip in its adjusted position by virtue of the dimples projecting into an associated through hole 7 in the leg 2. When the clip 9 is applied to the leg 2, the divergent tabs 16 project beyond the associated inner edge of the leg 2 and loosely embrace the opposite leg 2' when the two legs are sprung together as illustrated in FIG. 2. It should be noted that the V-shaped notches 17 lie coincident with pairs of notches 5 when the dimples engage the through holes 7.

The head 3, at its outer end portion, has a nail-receiving hole 22 therethrough from face to face. Such hole 22 is in the central longitudinal vertical plane of the body 1.

Figure 3:
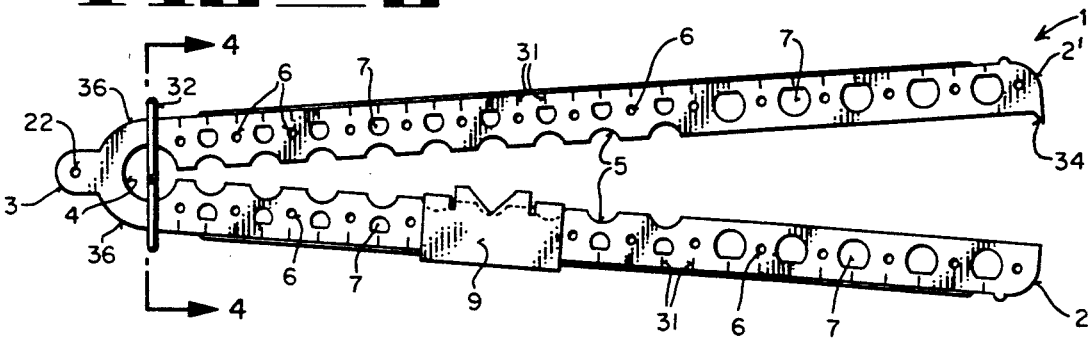
FIG. 3 is an enlarged plan view of the anchor bolt holder, shown detached from the anchor bolt and detached from the concrete form.
Figure 4:
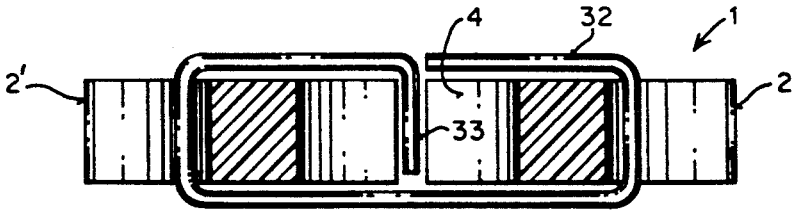
FIG. 4 is a vertical cross-sectional view taken along the plane indicated by the line 4—4 of FIG. 3.

In one manner of use of the described holder, an anchor bolt 8 is disposed intermediate its ends between the legs 2 and 2' in alignment with selected registering notches 5 and the V-shaped notch 17, and the legs 2 and 2' are then forcefully manually sprung substantially together in order to firmly and positively frictionally grip or clamp the anchor bolt in a selected notch 5 in leg 2' and in the V-shaped notch 17 in the slidable clip which has now been adjusted to a desired position along the leg 2. It has been found that when the free ends of the legs are brought together as shown in FIG. 3, the leg portions on the opposite side of the anchor bolt from the free ends of the legs bow resiliently outwardly, the anchor bolt acting as a fulcrum so that the legs on either side of the anchor bolt converge slightly toward their respective ends from the position of the anchor bolt.

With the legs 2 and 2' thus sprung together at their free ends, the body of the holder is spanned between spaced form boards 23 and 24 of a pre-erected concrete retention form designated generally by the numeral 26, and a nail 27 is driven through the hole 22 in head 3, and into form board 23, while nails 28 are driven through the related holes 6 in legs 2 and 2', into form board 24. Thus secured in spanning relation to the form boards 23 and 24 (while also serving as a cleat), the holder effectively supports the anchor bolt in a pre-selected suspended position for embedding of the lower part of the bolt in concrete to be poured into the form between the form boards.

In order to aid the selection of the proper registering notches 5 and 17 of the clip for reception of the anchor bolt 8, the position of which is dependent upon the spacing of form boards 23 and 24, the legs 2 and 2' are marked or scribed with indicia or graduations 31, in increments of an appropriate linear measure as shown. The nails used to secure the holder to the form boards are preferably of the double-headed type whereby to permit of ready pulling of such nails with a claw hammer or claw bar for removal of the body 1 of the holder for re-use.

A sliding collar 32 fabricated from heavy gauge wire embraces the body 1 transversely thereof. The collar, which is formed substantially rectangular, includes a central cross finger 33 which extends between the two legs 2 and 2' and prevents escape of the collar from the body at the head-end of the latter, where the collar is initially disposed. The central cross finger 33 also cooperates with an inwardly projecting flange 34 formed integrally on the leg 2' at its extreme free end as shown. When the legs 2 and 2' are sprung together, the flange 34 abuts the inner surface of the leg 2, thus effectively closing off the opening that normally exists between the free ends of the legs. The outer longitudinal edges 36 of the legs 2 and 2' diverge relative to each other toward the captured anchor bolt to form divergent cam surfaces from the head 3 for substantially the length of the inner half of the body 1 as a result of the bowing action previously discussed. After an anchor bolt 8 is frictionally gripped or clamped between the legs 2 by springing the latter toward each other, the grip on such bolt may if desired or necessary be increased by sliding the collar 32 along the body 1 toward the bolt 8. The ends of the collar advance in contact with the divergent cam surfaces 36, further urging the legs toward each other and imposing an additional clamping force on the anchor bolt as shown in FIG. 1. Since the legs 2 and 2' will also converge toward their free ends when the ends are pulled together due to the same bowing action previously discussed, it will be understood that a second collar 37 may be applied to embrace the body between the free ends of the legs and the captured anchor bolt. This second collar, when slid along the body toward the captured anchor bolt, functions to tighten the legs on the anchor bolt due to the camming action of the collar on the two outer edges of the legs. When desired or necessary, this cooperative camming action of the two collars enables the pre-assembly of the holder on an anchor bolt, with subsequent application of the assembly to the upper edges of the form boards.

While this specification makes reference to the holder being for the purpose of gripping and supporting an anchor bolt, such term shall be deemed to include all equivalent structural elements such as reinforcing bars, electrical conduits, and the like. From the foregoing description, it will readily be seen that there has been provided such an anchor bolt holder as substantially fulfills the objects of the invention as set forth herein.

While this specification sets forth in detail the present and preferred construction and operation of the anchor bolt holder, still in practice such deviations from such detail may be resorted to as do not constitute a departure from the spirit of the invention as defined by the appended claims.

I claim:

1. A holder for a structural element to be partially embedded in a fixed position in concrete during pouring of concrete in a pre-erected form including form boards spaced apart, said holder comprising:

a) a bifurcated body having a pair of normally divergent elongated side-by-side legs dimensioned to span the space between the spaced form boards for suspending the structural element therebetween;

b) means connecting the legs at one end and enabling movement of the legs toward each other whereby to clamp and support the structural element disposed therebetween;

c) a clip slidably mounted on at least one of said legs and including at least one notch positioned to engage said structural element when it is disposed between said legs and the legs are moved toward each other into clamping relationship.

d) retention means including a pre-formed hole in each of said legs for removably securing the legs of the body in fixed spanning relation to said form boards and in clamping engagement with said structural element whereby said retention means including said pre-formed hole retains said holder normally fixed against significant movement relative to said form boards; and e) said means connecting the legs at said one end including a head integral with the legs and having a pre-formed hole extending through said head and said means for securing said body in spanning relation to said form boards includes a form board penetrating nail extending through said pre-formed hole in the head of said body and form board penetrating nails extending through said pre-formed holes in said legs.

2. The holder according to claim 1, wherein said holder body is formed from synthetic resinous material, and said clip slidably mounted on said at least one of said legs of the body is formed from metal, whereby said notch in the clip clampingly engages the structural member when the legs are moved into clamping relationship.

3. The holder according to claim 2, wherein a series of spaced aligned holes are provided in the leg on which said clip is slidably mounted, and detent means are provided on said clip received in said holes to normally retain said clip in a selected position yet enabling selective adjustment of the clip to another position along the leg on which it is mounted.

4. The holder according to claim 3, in which collar means are provided slidably embracing said legs and movable therealong in a direction away from the ends thereof when the legs are clamped on the structural element whereby to impose a progressively increasing transverse clamping force on said legs to more tightly clamp the legs to the structural element.

5. The holder according to claim 4, wherein means are provided on the free ends of said legs to prevent inadvertent separation of said collar from said legs.

6. The holder according to claim 5, wherein said collar constitutes a closed ring embracing both legs, and includes a transverse finger extending between the adjacent edges of the legs between opposite sides of the closed ring whereby each leg is independently embraced by a portion of the closed ring and said transverse finger.

* * * * *